United States Patent [19]

Rosendahl

[11] 4,184,670

[45] Jan. 22, 1980

[54] APPARATUS FOR REMOVING FLAT ELEMENTS FROM A STACK THEREOF

[75] Inventor: Bengt Rosendahl, Kalmar, Sweden

[73] Assignee: AB Sture Ljungdahl, Nybro, Sweden

[21] Appl. No.: 905,864

[22] Filed: May 15, 1978

Related U.S. Application Data

[63] Continuation of Ser. No. 761,361, Jan. 21, 1977, abandoned.

[30] Foreign Application Priority Data

Feb. 13, 1976 [SE] Sweden ..... 7601628

[51] Int. Cl.[2] ..... B65H 3/10; B65H 1/06

[52] U.S. Cl. ..... 271/12; 271/94; 271/99; 271/165

[58] Field of Search ..... 271/12, 13, 11, 99, 271/94, 96, 165, 100, 108, 95, 5, 14, 15, 270; 414/128, 129

[56] References Cited

U.S. PATENT DOCUMENTS

| | | | |
|---|---|---|---|
| 3,008,706 | 11/1961 | Heigl et al. | 271/101 X |
| 3,372,924 | 3/1968 | Treff | 271/12 X |
| 3,423,084 | 1/1969 | Konazewski | 271/100 |
| 3,834,691 | 9/1974 | Paulson | 271/12 X |
| 3,851,871 | 12/1974 | Aronson | 271/99 X |

*Primary Examiner*—Bruce H. Stoner, Jr.

*Attorney, Agent, or Firm*—Hane, Roberts, Spiecens & Cohen

[57] ABSTRACT

Apparatus for feeding sheets one by one from the bottom of a stack of sheets comprising first and second spaced supports cooperatively supporting the bottom of a stack of sheets, the first support comprising a rotatable unit and the second support comprising a flat abutment member. The rotatable unit includes a plurality of juxtaposed rollers at least one of which is intermittently rotated to feed the lowermost sheet in the stack to a conveyor. The flat abutment member is adjustably supported for displacement to a selected predetermined stationary position. The rotatable roller is coupled to a suction device so that suction force is applied to the lowermost sheet in the stack in the course of intermittent rotation and the position of the roller with the conveyor belt is such that the suction will be substantially reduced when the sheet has been received by the conveyor belt.

9 Claims, 7 Drawing Figures

APPARATUS FOR REMOVING FLAT ELEMENTS FROM A STACK THEREOF

This is a continuation of application Ser. No. 761,361 filed Jan. 21, 1977, now abandoned.

BACKGROUND OF THE INVENTION

The present invention relates to a device which can take flat units from a stack, one unit at a time. Such devices find practical use in connection with systems where a sheet of paper is to be put into an envelope. Usually, the sheets of paper are stacked in a unit and placed in a holding device. From this holding device the sheets are conveyed in one way or other to the envelope, where they are inserted by machine. This insertion is desired to be performed as quickly and as safely as possible.

An object of the present invention is to provide apparatus to take sheets of paper from a stack as fast as possible, one sheet at a time, and to insert this sheet into an envelope. This is performed by means of the present invention by placing a stack of sheets on two supports which are placed next to each other. The two supports are parallel with each other and they lie true against two opposite edges of the bottom sheet. One of the supports is stationary, but it can be adjusted into various positions. The other support can rotate and it has a part which can suck the edge of the bottom sheet which lies true against the support, and when the sheet has been sucked it will be carried on to a conveyor belt. When the sheet is carried on to the conveyor belt the speed of the sheet can be increased so that the sheet has the same speed as the conveyor belt when it reaches the belt.

According to the present invention it is suitable for the other support to have the shape of three rollers situated next to each other and with the same axis of rotation. The two outer rollers can rotate at a constant speed, whereas the intermediate roller rotates intermittently and is equipped with suction devices so that the roller regularly sucks sheets of paper which lie true against the support. This roller is primarily arranged in such a way that it will rotate part of one revolution, primarily one quarter of a revolution or part of a revolution at a time. Between every part of a revolution or quarter of a revolution is an interval so that a sheet which is fed further on by the roller has left the stack before the next sheet is sucked so that it lies true against the roller. The sheet will best lie true against the roller when this is mainly stationary. The interval can be obtained by means of, for instance, a coupling containing a wheel with radial tracks, such as a Maltese cross. Such a coupling is described in the book called "Handbok i Finmekanik" (Handbook of Precision Mechanics) page 426, which book has been revised by Bartil Ejerhed.

According to the invention it is suitable for the intermediate roller to have a hollow shaft which is connected with a suction unit, for instance a vacuum pump, and in the shaft are provided a number of holes which are placed axially next to each other and which serve as suction openings. On the surrounding, intermediate roller can be arranged corresponding holes in its periphery to cooperate with the holes in the hollow shaft. In this way, the intermediate roller when rotating and passing the holes of the hollow shaft is going to have an increasing suction capacity, which reaches a maximum and then decreases depending upon the rotation of the roller.

According to the invention, the rollers described can be replaced by a number of wheels which have the same function as the rollers.

BRIEF DESCRIPTION OF THE DRAWINGS

The present invention will be described in detail in connection with the enclosed drawings, where.

DETAILED DESCRIPTION

Figure 1:
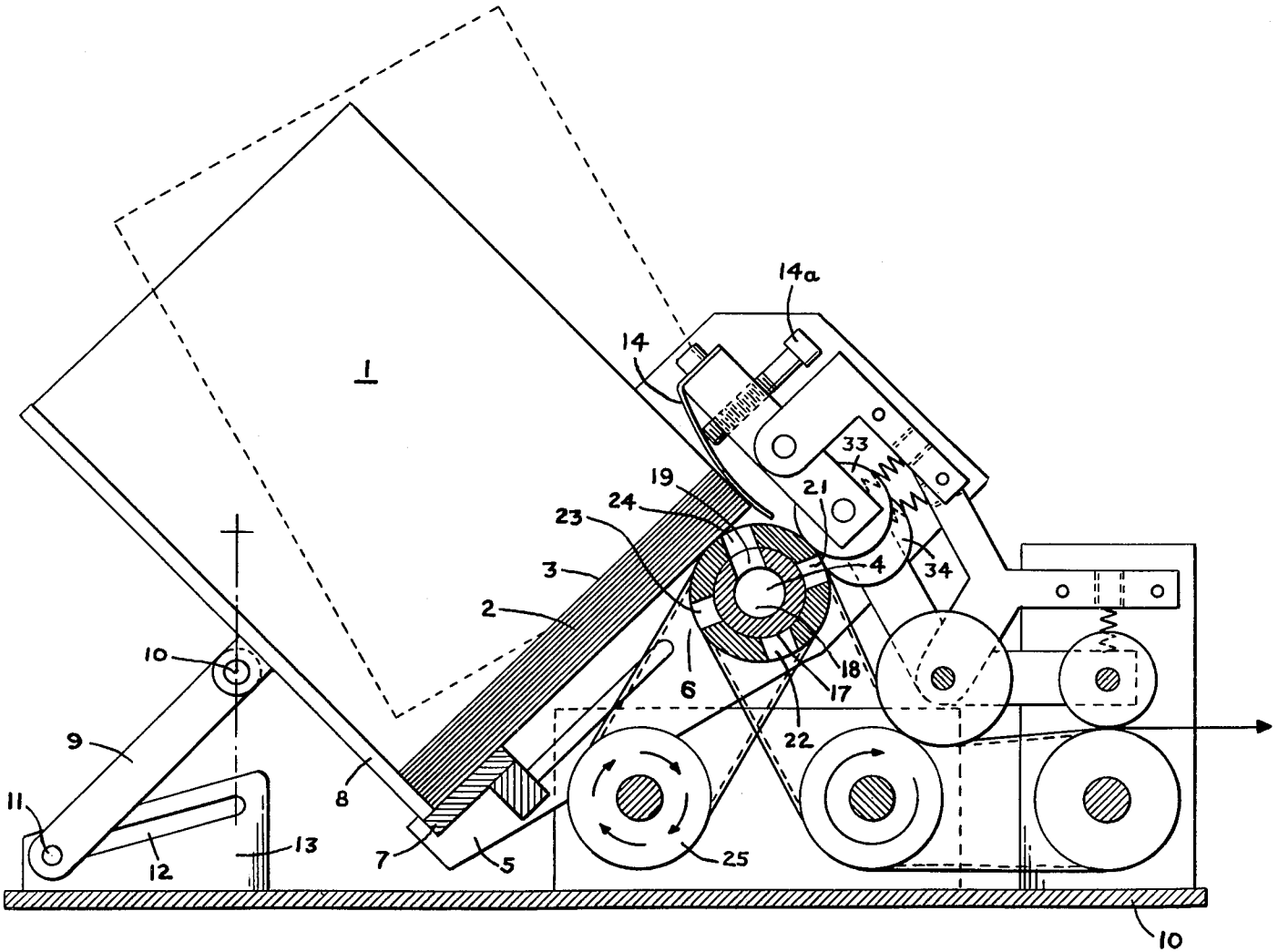
FIG. 1 is a side view of a device according to the present invention.
Figure 2:
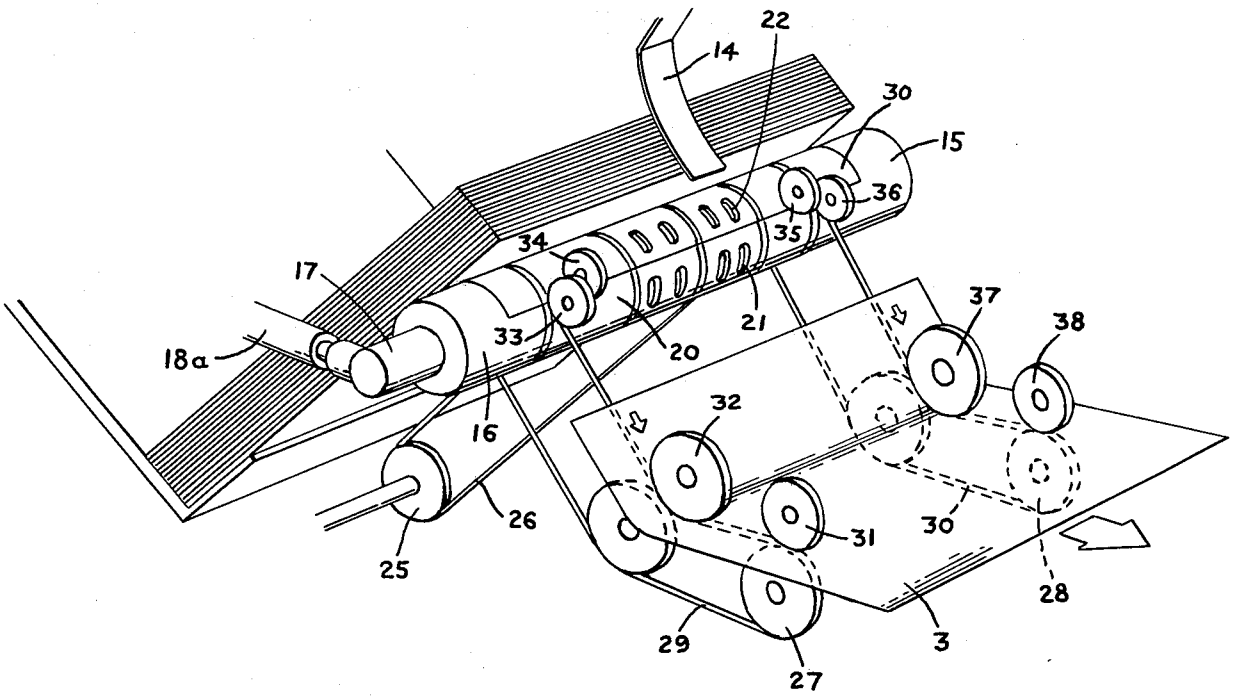
FIG. 2 shows in perspective and schematically the device according to FIG. 1.
Figure 3:
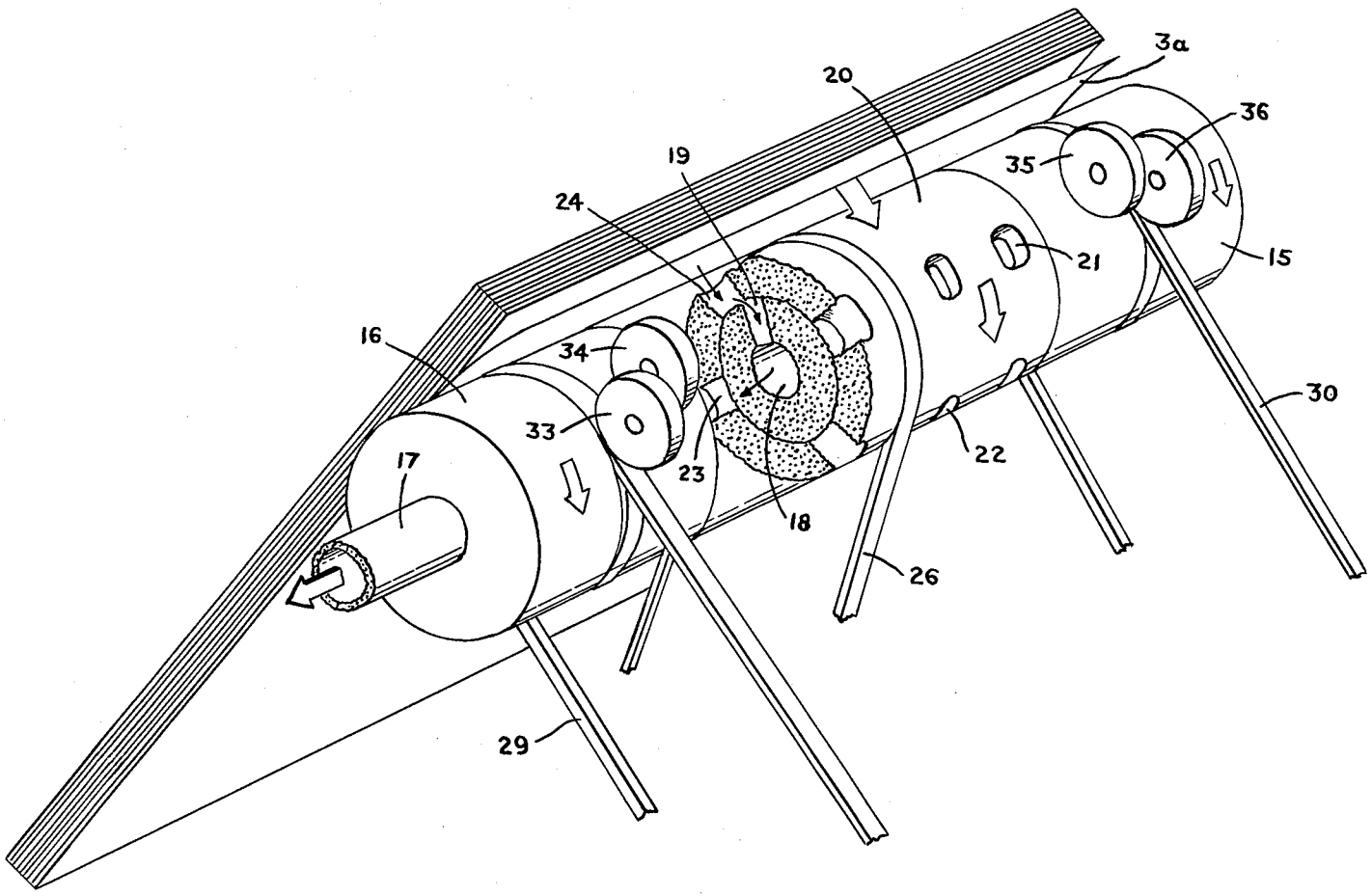
FIG. 3 shows how the bottom sheet is sucked towards the rollers according to the present invention.
Figure 4:
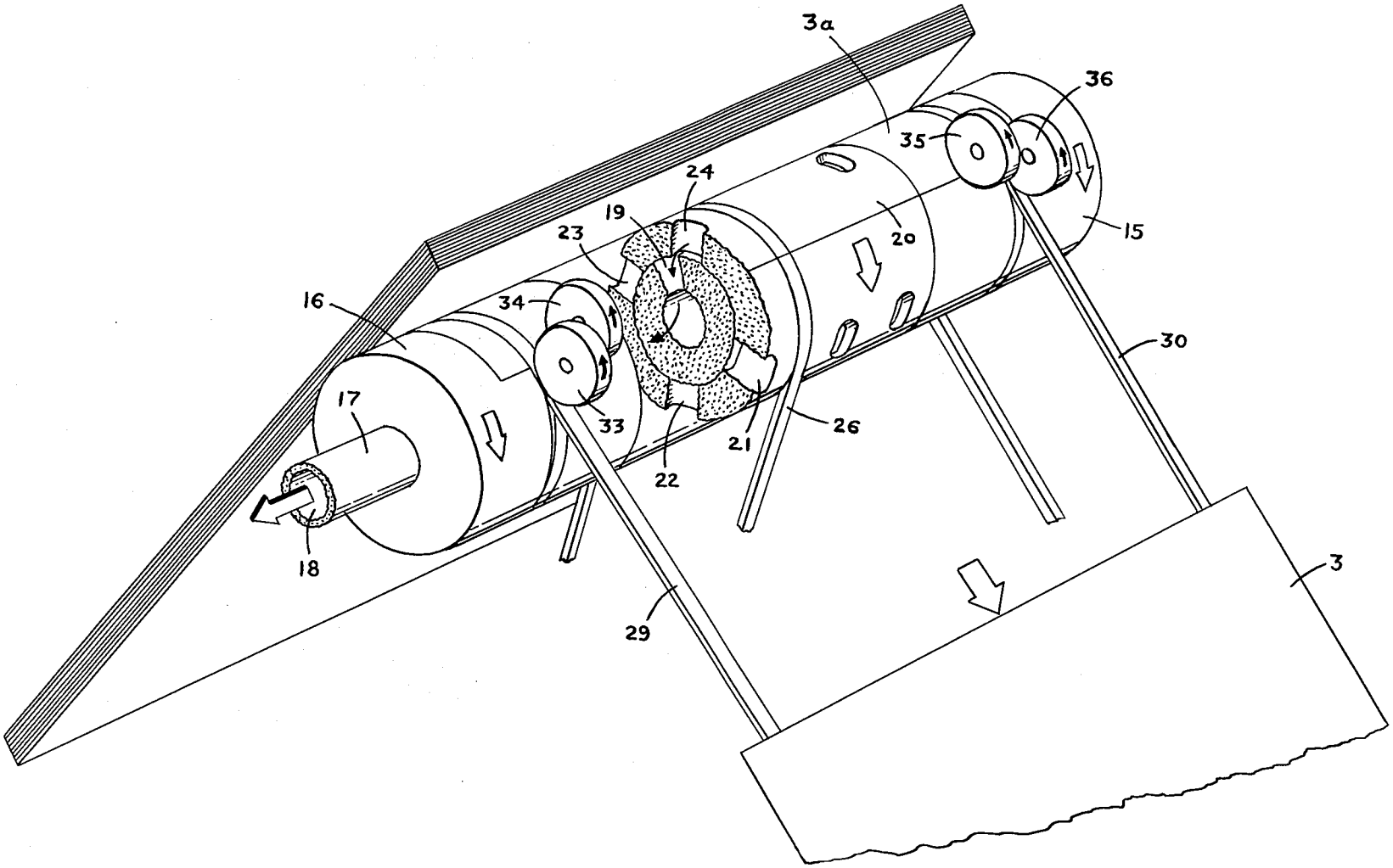
FIG. 4 shows how the bottom sheet is sucked firmly against the roller and brought into contact with the transport device.
Figure 5:
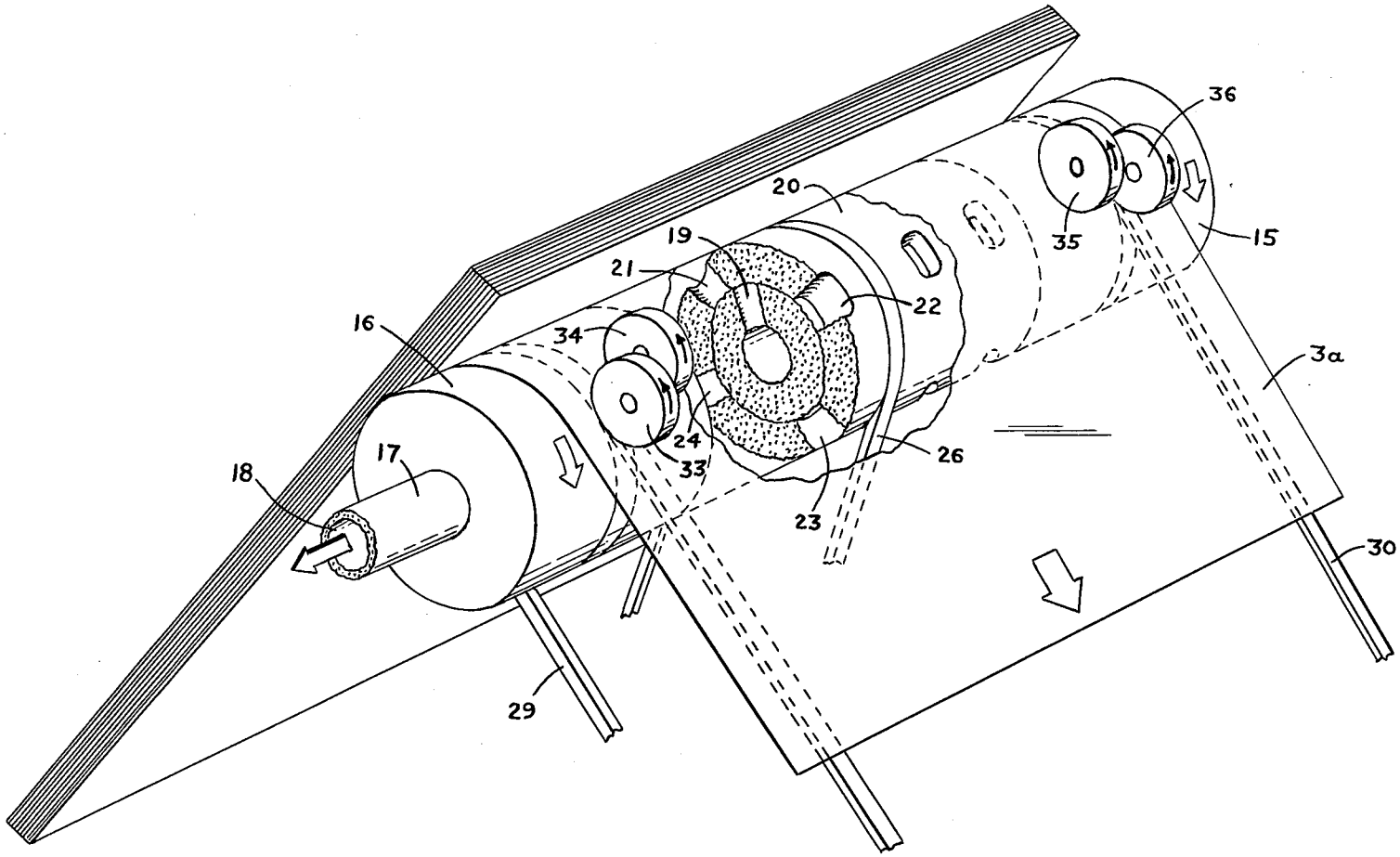
FIG. 5 shows the sucked sheet during the feeding operation into the transport device, when the sheet has not left the rollers, but is not firmly sucked against the roller, and FIGS. 6 and 7 respectively show a coupling device in side elevational view and in section, which coupling device produces an intermittent movement of the intermediate roller.
Figure 6:
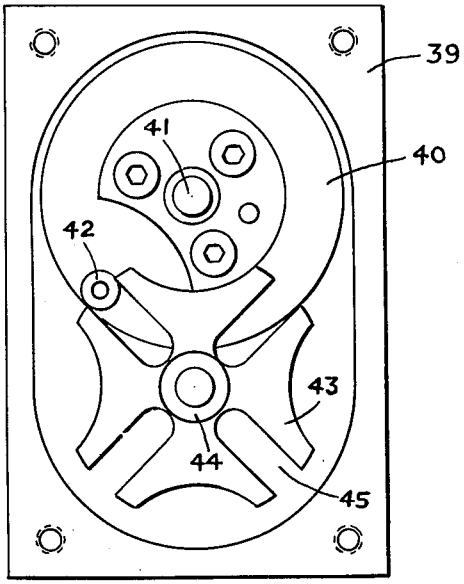
Figure 7:
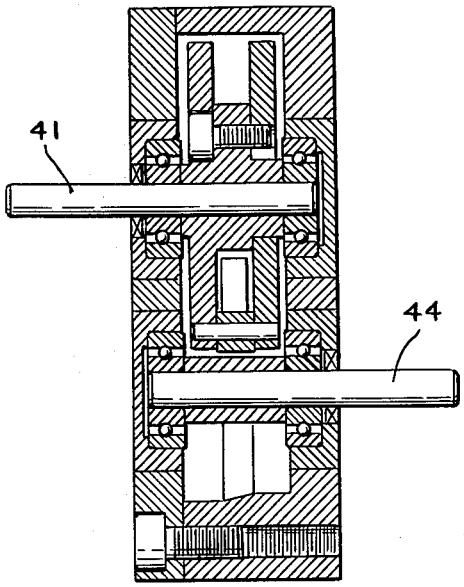

In the figures numeral 1 represents a stack container for a stack 2 of rectangular sheets 3. The sheets can have a shape which is different from the rectangular shape and the sheets could even consist of sheets which have been folded once, or sheets which have been folded a couple of times so that several sheets which are placed on each other and linked together are obtained. The sheets can be made of any suitable material such as paper, plastic foil, aluminium foil, etc. The stack is revolvably arranged around a shaft 4. The stack container has two side flanges, of which one 5 is visible. Between the flanges is arranged a rotary, first abutting part 6 for a stack of sheets. The stack container 1 is equipped with a second abutting part 7, which is made up of two transverse flanges. The stack container can rotate around the shaft 4. The stack container 1 also has a side support 8. The position of the stack container around the shaft 4 can be adjusted by means of an adjusting device 9, the right end of which is connected by pin 10 to the side support 8, and the other end of which has a lockable pin 11, which can slide along a track 12 in a flange 13. The adjustment device described can be arranged on both sides of the stack if necessary. The flange 13 is firmly fixed to a base plate 1*a* of the device. The side of the stack opposite support 8 is equipped with a contact spring 14. The purpose of this contact spring 14 is to press the stack against the side support 8. The pressure of the contact spring can be adjusted, for instance, by means of a screw 14*a*. A rotary, first abutting part consists of two outer rollers 15 and 16, and an intermediate roller 20, which is placed between these two rollers. The three rollers are rotatably arranged around a hollow shaft 17. A cavity 18 in the hollow shaft 17 is connected with a suction device 18*a*, for instance, a vacuum pump or similar device. In the area of the intermediate roller 20, the hollow shaft has four holes 19 situated in axially spaced relation on the same generatrix. The intermediate roller also has four groups 21, 22, 23, and 24 of four holes, which are also arranged along their individual generatrices at the outer surface of the intermediate roller. The four groups are situated at a distance of 90° from each other, and when one group is situated directly in front of the group of holes 19 in the hollow shaft, the holes in the shaft and the intermediate roller 20 will form flow-through channels. The angular distance between the holes 21-24 of the groups may vary, which is also the case for the number of groups. Numeral 25 represents a driving wheel, which is connected with a driving device for the intermediate roller 20. Over the driving wheel 25 is situated a driving belt 26, which runs around a peripheral track of the intermediate roller. The driving device for the intermediate roller is intermittent, and when it is in operation the speed accelerates up to a pre-determined speed and then stops; and after a certain interval the same operation is repeated. The shaft of the driving wheel 25 is made up of shaft 44 of a coupling device 39, which has a wheel 40 that is driven by a shaft 41, which is continuously driven at a constant speed. The wheel 40 is fitted with a pin 42 which operates with a Maltese cross 43, which can rotate around shaft 44, and which has radial tracks 45, with which the pin 42 cooperates. The Maltese cross will move a quarter of a revolution at a time. It should be obvious that the coupling device 39 can be constructed in such a way that the cross 43 will move by a degree of a revolution other than 90°. Numerals 27 and 28 represent two driving wheels for the two outer rollers 15 and 16, and these driving wheels are both driven at a constant speed corresponding to the maximum speed of the driving wheel 25. The driving wheels 27 and 28 operate respective driving belts 29 and 30, which run in peripheral tracks on the outer rollers 15 and 16. On the driving belts 29 and 30 and on the outer rollers 15 and 16 are arranged pressure wheels or abutting wheels 31-38.

The device described above operates in the following manner.

The stack of sheets 2 is placed in stack container 1, so that one end of the stack lies against the abutting part 7, while the opposite end of the stack lies against the abutting part 6, which has a purely cylindrical outer surface. The contact spring 14 is tightened by means of the screw 14*a*, so that the stack of sheets lies true against the side support at the pressure desired. Then the stack container is turned so that it assumes the desired angular position. In the desired angular position, the adjusting arm 9 is firmly locked by means of the lockable pin 11. The side support 8 can also be shifted transversely and locked in the desired position, so that the stack of sheets 2 has a desired overhang in proportion to the abutting point on the rotary abutting part 6. Then the driving wheels 27 and 28 are started in such a way that they will rotate at a constant speed, which will have the effect that the two outer rollers 15 and 16 will rotate at a certain speed. Because of low friction nothing will happen to the sheets in stack 2. Then the intermittent operation of the driving wheel 25 is started, and it is intended that the holes 24 will be situated fully to the left of the holes 19. If the intermediate roller 20 is then moved slowly counter-clockwise, first a narrow suction channel will appear and then progressively the suction channel will increase to the size which is shown in FIG. 1. In this position the intermediate roller is somewhat stationary in order to facilitate the suction of the sheet firmly to the roller. As soon as the suction movements start, the bottom sheet 3*a* in the stack 2 will be sucked down towards the three rollers 15, 16, and 20. When the end of the sheet 3*a* has been sucked so that it lies true against the three rollers the sheet will be carried further on towards the abutting wheels 33-36. When the sheet 3*a* reaches the wheels 33-36 it will have the same speed as the driving wheels 27 and 28. During the feeding movement of the firmly sucked sheet, the suction capacity will decrease gradually and it will stop when the front end of the sheet comes into contact with the abovementioned abutting wheels 33-36. Then the following holes 23 in the intermediate roller are brought into alignment with the holes 19, when the sheet 3*a* has been fully engaged by the wheels 33-36. The holes 21, 22, 23, and 24 are then brought to take up successively an aligned position in relation to the hole 19. The primary concern of the invention is that the bottom sheet in the stack is given sufficient time to be brought into a position where it lies true against the intermediate roller 20.

I claim:

1. Apparatus for feeding sheets one by one from the bottom of a stack comprising first and second spaced support means for supporting the bottom of a stack of sheets, said first means comprising a plurality of juxtaposed rotatable units, means for rotating at least one of said units intermittently in a given direction of rotation to feed the lowermost sheet in the stack intermittently forwards, said means for rotating said at least one unit intermittently comprising a Maltese cross coupled to said at least one unit for rotating the same stepwise between successive stationary positions and providing maximum speed between successive stationary positions, means for displacing said second means to a selected pre-determined stationary position, suction means coupled to said first means to apply suction force to the lowermost sheet in the stack in the course of intermittent rotation of said first means, and a conveyor belt positioned relative to said first means and driven at a predetermined speed to receive the intermittently fed sheets and to advance the same, the rotated unit of said first means comprising a roller having at least one radial hole, said suction means comprising a stationary hollow shaft rotatably supporting said roller and subjected to suction, said hollow shaft having a radial hole which comes into substantial alignment with the radial hole in the roller in the course of intermittent rotation of said roller when said roller is stationary, said radial hole in said roller and said radial hole in said hollow shaft being positioned and having respective extents such that the suction effect is substantially reduced when the fed sheet has entered the conveyor belt, said roller then being at maximum speed which is correlated with the speed of the conveyor belt so that when the fed sheet enters the conveyor belt directly from the roller it will have substantially the same speed as the conveyor belt.

2. Apparatus as claimed in claim 1 wherein said second means is adjustable about an axis coincident with the axis of rotation of the intermittently rotatable unit.

3. Apparatus as claimed in claim 1 wherein said units comprise a plurality of rollers situated next to each other, and a common shaft rotatably supporting said rollers.

4. Apparatus as claimed in claim 3 wherein said rollers are constituted as wheels.

5. Apparatus as claimed in claim 3 wherein selected of said rollers are coupled to said suction means and the remaining rollers are driven continuously in rotation.

6. Apparatus as claimed in claim 1 wherein said second means comprises an abutment member for support of the stack of sheets proximate one of the edges thereof, said rotatable units supporting the stack of sheets proximate the other of the edges thereof, means for pivotably moving said stack around the axis of rotation of said one unit, and means for shiftably displacing the abutment member relative to said first means.

7. Apparatus as claimed in claim 1 comprising side support means for said stack, contact spring means for resiliently bearing against said stack to hold the same against said side support means, and means for adjusting the pressure of said contact spring means.

8. Apparatus as claimed in claim 7 wherein said side support means is supported in an adjustable position inclined with respect to the horizontal so that the stack of sheets bears gravitationally on said first and second support means.

9. Apparatus as claimed in claim 8 wherein the displacing means comprises a fixed support, an adjusting link slidable along an inclined track on said fixed support, means pivotably connecting said link to said side support, and side flanges rotatably supported about the axis of rotation of said rotatable unit, said second means comprising an abutment member adjustably supported by said side flanges.

* * * * *